US007207391B2

(12) United States Patent
Crabtree et al.

(10) Patent No.: US 7,207,391 B2
(45) Date of Patent: Apr. 24, 2007

(54) SELECTABLE FIXED FLOW LARGE SCALE FIRE FIGHTING NOZZLE WITH SELECTABLE ADDITIVE PROPORTIONING AND LIGHT WEIGHT COST EFFECTIVE CONSTRUCTION

(75) Inventors: Dennis W. Crabtree, Beaumont, TX (US); Thomas E. Mason, Washington, IN (US); Kirk A. Barnes, Silsbee, TX (US)

(73) Assignee: Williams Fire & Hazard Control, Inc., Vidor, TX (US)

( * ) Notice: Subject to any disclaimer, the term of this patent is extended or adjusted under 35 U.S.C. 154(b) by 187 days.

(21) Appl. No.: 10/981,897

(22) Filed: Nov. 4, 2004

(65) Prior Publication Data

US 2006/0090907 A1 May 4, 2006

(51) Int. Cl.

| | |
|---|---|
| ***A62C 2/00*** | (2006.01) |
| ***A62C 35/00*** | (2006.01) |
| ***A62C 31/00*** | (2006.01) |
| ***B05B 7/12*** | (2006.01) |

(52) U.S. Cl. ..... 169/44; 169/14; 169/27; 239/398; 239/407; 239/413; 239/436

(58) Field of Classification Search ..... 169/44, 169/14, 27, 78, 85; 239/398, 407, 413, 436, 239/437, 443

See application file for complete search history.

(56) References Cited

U.S. PATENT DOCUMENTS

| | | | | |
|---|---|---|---|---|
| 3,863,844 | A * | 2/1975 | McMillan | 239/452 |
| 4,224,956 | A | 9/1980 | Klein | |
| 4,640,461 | A | 2/1987 | Williams | |
| 5,082,633 | A * | 1/1992 | Stuper | 422/133 |
| 5,445,226 | A * | 8/1995 | Scott et al. | 169/15 |
| 5,538,784 | A * | 7/1996 | Subramanian | 428/297.4 |
| 6,749,027 | B1 | 6/2004 | Crabtree | |

* cited by examiner

*Primary Examiner*—Davis Hwu
(74) *Attorney, Agent, or Firm*—Sue Z Shaper

(57) ABSTRACT

An industrial scale fire fighting nozzle and method, the nozzle having a selectively adjustable discharge gap and providing for gap coordinated, independently selectable additive proportioning ratio selection, the method including discharging fire fighting fluid at a selectively adjustable flow rate with an independently selectable, gap coordinated adjustable additive proportioning ratio, and use of reinforced high temperature polymer for at least a barrel element or a bafflehead element component.

14 Claims, 19 Drawing Sheets

FIG. 7
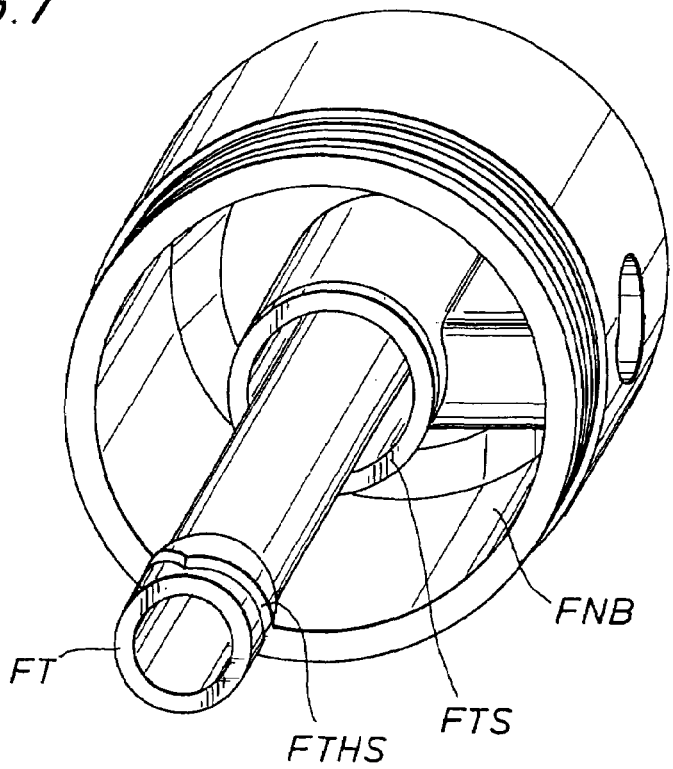
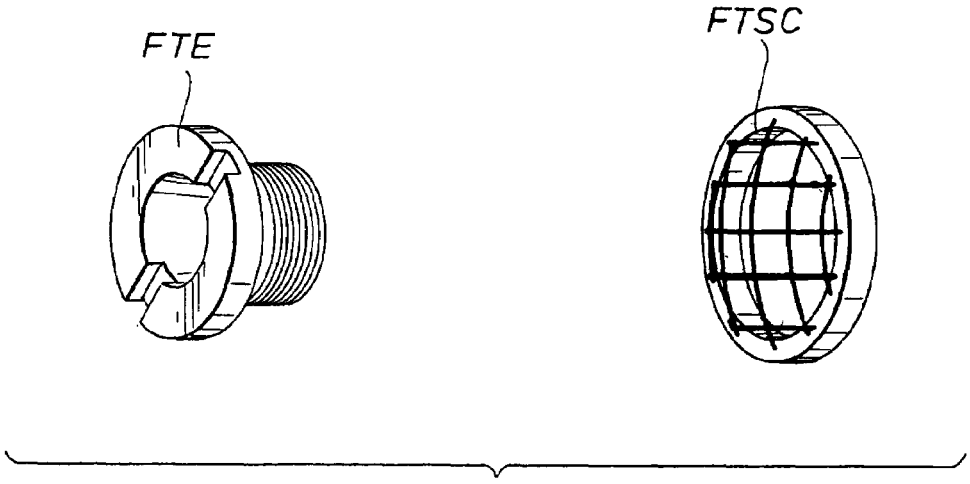
FIG. 8

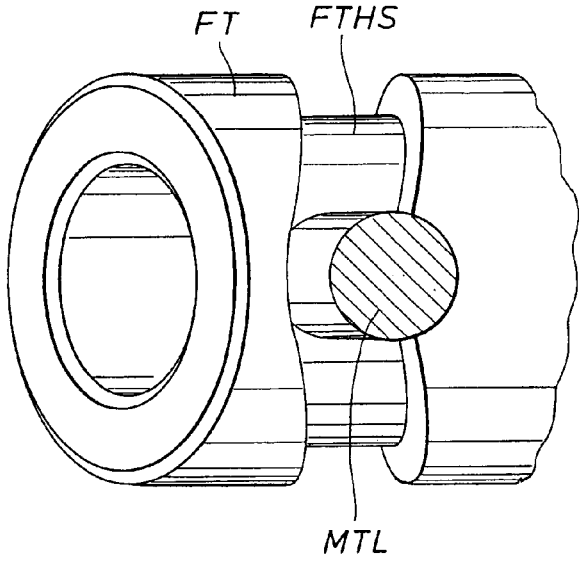
FIG. 9
FIG. 11
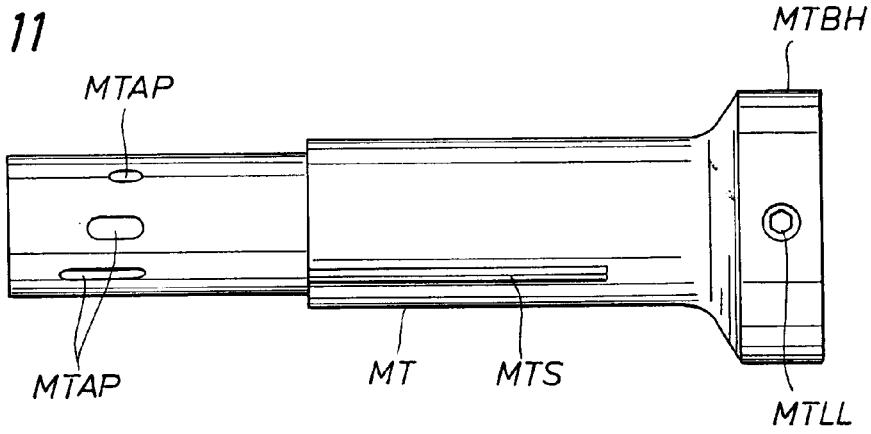
FIG. 12
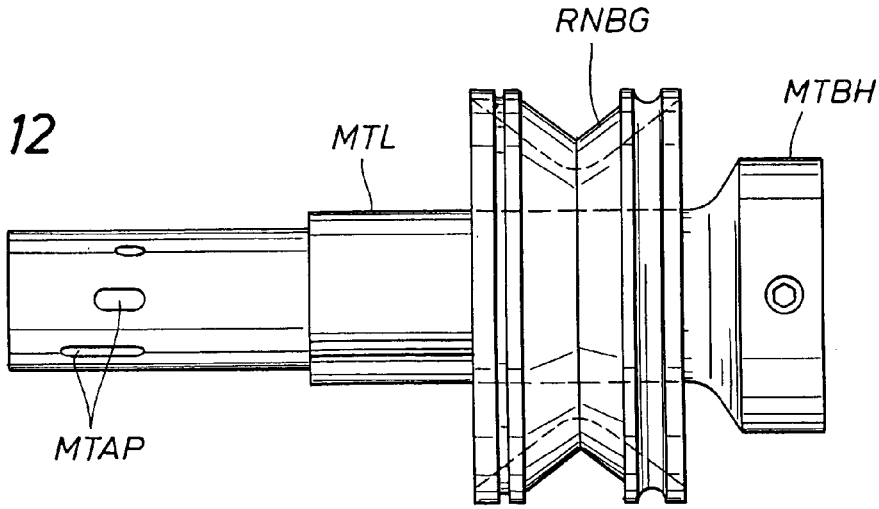

FIG.17E

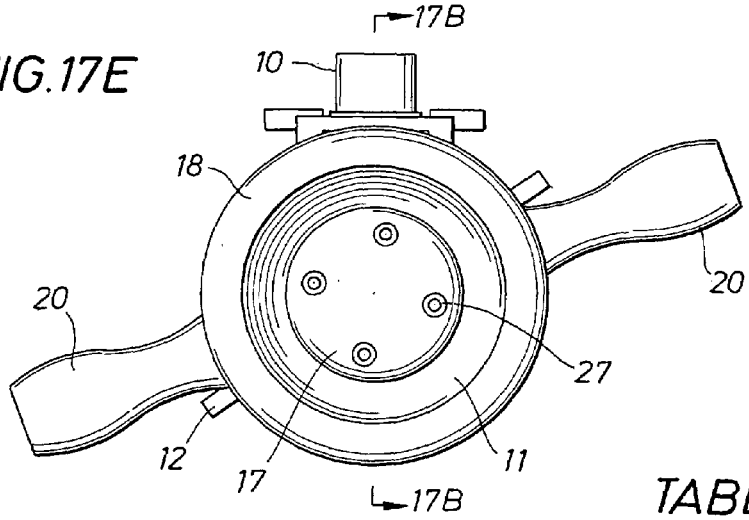

TABLE II

| NO. | DESCRIPTION | REFERENCE NO. |
|---|---|---|
| 1 | SWIVEL INLET NUT | |
| 2 | GASKET, SWIVEL ADAPTER | |
| 3 | BALL BEARING | |
| 4 | NOZZLE BODY | FNB |
| 5 | FOAM EDUCTING JET | FTE |
| 6 | JET INLET GUARD | FTSC |
| 7 | FOAM SEAL | |
| 8 | LATCH MOUNTING BLOCK | ACB |
| 9 | FLOW LOCK | |
| 10 | FOAM INLET ADAPTER | AC |
| 11 | STREAM STRAIGHTENER MODULE | |
| 12 | FLOW LOCK RING | |
| 13 | NOZZLE ASSEMBLY ROD | |
| 14 | OUTLET NOZZLE/BEARING HEAD | |
| 15 | CENTER TUBE/FOAM TUBE | FT |
| 16 | BAFFLE HEAD/METERING TUBE | MT |
| 17 | FLOOD PLATE | MTMP |
| 18 | PATTERN CONTROL SLEEVE | RNBSL |
| 19 | ADAPTER | |
| 20 | HANDLE | |
| 21 | SETSCREW | |
| 22 | NOZZLE FLOW LABEL | |
| 23 | SET SCREW | |
| 24 | NOZZLE IDENTIFICATION LABEL | |
| 25 | SETSCREW | |
| 26 | SCREW, PAN HEAD | |
| 27 | SCREW, BUTTON HEAD | |
| 28 | SETSCREW | |

TABLE I

| PLASTIC NOZZLE PROPERTIES | | | |
|---|---|---|---|
| 1 | STRENGTH TO WEIGHT | | |
| 2 | SPECIFIC GRAVITY <OR = | | 1.75 |
| 3 | TENSILE STRENGTH (YIELD) >OR = | psi | 8000 |
| 4 | TENSILE MOD. OF ELASTICITY a 73F>OR = | psi | 425000 |
| 5 | TENSILE ELONGATION AT BREAK @ 73F > | % | 1 |
| 6 | FLEXURAL STRENGTH a 73F>OR = | psi | 12500 |
| 7 | FLEXURAL MODULUS OF ELASTICITY @ 73F >OR = | psi | 425000 |
| 8 | SHEAR STRENGTH >OR = | psi | 8000 |
| 9 | COMPRESSIVE STRENGTH>OR = | psi | 12500 |
| 10 | COMPRESSIVE MODULUS OF ELASTICITY @ 73F <OR = | psi | 425000 |
| 11 | HARDNESS, ROCKWELL >OR = | | R 120 |
| 12 | HARDNESS, DUROMETER, SHORE D >OR = | | D83 |
| 13 | IZOD IMPACT (NOTCHED) @ 73F | ft-Lb/in | 1 |
| 20 | CONTINUOUS SERVICE TEMP. >OR = | F | 300 |
| 27 | WATER ABSORPTION, IMERSION, 24 hrs <OR = | % | 0.75 |
| 28 | WATER ABSORPTION, SATURATION <OR = | % | 1.5 |

SELECTABLE FIXED FLOW LARGE SCALE FIRE FIGHTING NOZZLE WITH SELECTABLE ADDITIVE PROPORTIONING AND LIGHT WEIGHT COST EFFECTIVE CONSTRUCTION

FIELD OF THE INVENTION

The invention lies in the field of large scale fire fighting nozzles, and more particularly in the field of fire fighting nozzles having a selectable discharge gap providing a wide range of fixed-flows, of nozzles requiring independently selectable additive proportioning, and of nozzles providing light weight, cost effective construction.

BACKGROUND OF THE INVENTION

In the field of large scale (250 gpm or greater) fire fighting nozzles, "fixed-flow" nozzles, in general, have long been traditional. A nozzle is "fixed-flow," or is referred to as "fixed-flow," when the nozzle discharge gap is fixed during use. The reference or term is used even when the discharge gap is selectively adjustable.

A nozzle discharge gap is typically the annular gap defined between a portion of a nozzle barrel and a nozzle bafflehead. One traditional adjustable fixed-flow nozzle design, for instance, permits the gap to be manually adjusted by screwing in and out a bafflehead located at the discharge end of the nozzle barrel.

In "fixed-flow" nozzles the flow rate, or gpm, varies with the square root of supplied fluid pressure. Although in practice there can be a significant variation in the fire fighting fluid supply pressure, variations which can run possibly +/−50%, the variation in the square root of that pressure is not great. Thus, the resulting variation in flow rate caused by a varying supply pressure is not too great. Thus, such nozzles, with the discharge gap fixed during flow, are referred to as "fixed-flow" nozzles.

(In contrast, by way of background, so called "automatic or "pressure regulating" nozzles automatically vary a nozzle discharge gap during use to attempt to maintain a pre-selected discharge pressure. Typically in such nozzles a bafflehead, assisting in defining the discharge gap, will be automatically adjusted to attempt to maintain a pre-selected discharge pressure. Since range tends to vary directly with pressure, "pressure regulating" nozzles tend to deliver fluid at a fixed range notwithstanding variations in supply pressure. Flow rate, however, in "pressure regulating" nozzles varies significantly. The flow rate varies with the variation in discharge gap used to target the discharge pressure. From this condition arises the contrast with "fixed-flow" nozzles. The instant invention is directed to improved "fixed-flow" nozzles.)

Additive, usually a foam or foaming concentrate, is frequently supplied to a fire fighting nozzle. It is designed by manufacturers to be proportioned into fire fighting fluid at a stated ratio, typically 1%, 3%, 6%, 10%. Various means have been developed in the industry to adapt for changing additive products during a job; that is, means have been developed to change from a product with one proportioning ratio to an additive product with another proportioning ratio. One such means has been the provision for the manual insertion of variable orifices in a flow path or line between an additive source and a nozzle. Small insertable orifices would be provided for additives designed to be mixed at lower ratios; larger orifices would be provided for additives designed to be mixed at higher ratios. Another variation, Klein U.S. Pat. No. 4,224,956, discloses a simple, manually adjustable proportioning valve, the valve adjustable between a set of stop positions, in order to proportion at different ratios.

The desire and/or ability to significantly adjust flow rate in a "fixed-flow" nozzle greatly complicates, however, this selection of a proper orifice. When flow rate can be widely adjusted, such as between 250 gpm and 500 gpm or greater, a selection of the proper orifice for proportioning additive, which is dependent upon flow rate (e.g. upon the adjusted size of the gap of the discharge,) becomes complex.

(In the field of "automatic" nozzles, discussed above, means have been invented [by the instant inventor] wherein an automatic variation in the discharge gap automatically provides a coordinated variation in a port in the additive fluid flow path, the variation being coordinated in two ways. One variation in port size is calibrated to automatically vary additive flow rate with variations in primary fluid flow rate caused by the nozzle's system of automatic adjustment. A second variation of port size is also calibrated to vary port size in accordance with a selected variation in the proportioning ratio of the additive. See co-pending patent application Ser. No. 10/677,900.)

The instant invention provides for a selectable "fixed flow" fire fighting nozzle with independently selectable, gap coordinated additive proportioning ratios. The additive proportioning ratios and flow rate selections are coordinated, but they are selectable independently of each other. That is, a fire fighter can select, independently, preferably by turning a dial, a flow rate and a proportioning ratio. A turn of the dial can select a different flow rate for the same proportioning ratio or a different proportioning ratio for the same flow rate, or both different. The instant invention provides a pre-calibrated orifice system, calibrated with a bafflehead adjustment system that controls discharge gap, such that bafflehead adjustment and additive orifice selection are independently selectable. For instance, if a nozzle provided for the selection between three flow rates and three additive ratios, then three bafflehead positions and nine orifice positions would be provided, one orifice position for each additive ratio at each flow rate. The orifice system lies in a fluid communication path between an additive source and the discharge end of the nozzle. To the best of applicant's knowledge, no prior art system has coordinated and cross calibrated a selection of nozzle-flow rates and a selection of additive ratio proportioning orifices.

The instant invention involves a further improvement. To the instant inventor's best knowledge, in the field of industrial-scale fire fighting nozzles, only very small nozzles have ever been offered in plastic either in whole or in part. These nozzles are typically referred to as "wash-down" nozzles in the industry. These nozzles offered in plastic have had a diameter of approximately 1½ inches or less and have been no longer than approximately 8 inches. Their flow rate has been less than 100 gpm. To date, plastics have not been used for critical parts of large industrial scale fire fighting nozzles. Industry concerns that have blocked the use of plastics in large industrial scale fire fighting nozzles include: (1) concern that plastics cannot sustain in general the high temperature of a fire and/or the high pressures of water, i.e. that their melting point and their yield strength is not sufficiently high; and (2) concern that plastics cannot sustain in general the high reaction loads such as the high thread stresses.

The instant inventor has determined, however, that as a material for constructing industrial scale fire fighting nozzles, plastics can offer significant cost and weight advantages. Plastics can be corrosion resistant and can include additives for controlling friction in order to facilitate sliding parts. Against the weight of tradition, the instant inventor therefore has experimented with the use of plastics for components of a preferred embodiment of a selectable fixed-flow, selectable additive proportioning, industrial scale fire fighting nozzle. The instant selectable fixed-flow, selectable proportioning nozzle, with complex inter related parts, offered an excellent test case for experimentation. Both the cost and the weight of an all metal nozzle could be ameliorated using lighter and cheaper plastic parts. Testing has proven that nozzle parts constructed of plastic can withstand the temperature, pressure and corrosion resistance required for the large industrial scale fire fighting nozzle. And as an added benefit, major customers for fire fighting nozzles include the major plastics manufacturers.

SUMMARY OF THE INVENTION

The invention comprises a fire fighting nozzle having a selectively adjustable discharge gap and an independently selectable, gap coordinated additive proportioning system. Nozzle elements define a selectively adjustable discharge gap and are structured in combination such that the gap is selectively adjustable between a plurality of positions. The nozzle includes an additive passageway associated with the nozzle, the passageway defined in a path of fluid communication between a nozzle discharge and an additive source. The passageway is selectively adjustable between at least four configurations. At least two configurations are correlated with at least two discharge gap positions. A selective adjustment of nozzle elements is independent of, but coordinated with, a selective adjustment of the additive passageway.

The invention also includes a method for discharging fire fighting fluid at a manually adjustable flow rate and providing for independently selectable, gap coordinated additive proportioning. The method includes relatively adjusting nozzle elements to define one of a plurality of selectively adjustable discharge gaps for the nozzle, each gap coordinated with one of a plurality of selectable additive proportioning ratios. The method includes adjusting an additive passageway, defined in a line of fluid communication between a nozzle discharge and an additive source, to one of at least four configurations. Each configuration corresponds to one of at least two discharge gap positions and to one of at least two additive proportioning ratios. The relative adjusting of nozzle elements is coordinated with an adjusting of additive passageway, and the discharge gap and additive proportioning ratios can be independently selected.

The invention also includes large scale fire fighting nozzle having a diameter of at least 2½ inches and a flow rate of up to 250 gpm, the nozzle including barrel elements and a bafflehead element. At least one of a barrel element and a bafflehead element are constructed of reinforced high temperature polymer. Preferably, a fiber reinforced high temperature polymer is used. In a preferred embodiment the nozzle is constructed essentially of material comprised of aluminum, an aluminum/magnesium alloy and a fiber reinforced high temperature polymer.

BRIEF DESCRIPTION OF THE DRAWINGS

A better understanding of the present invention can be obtained when the following detailed description of the preferred embodiments are considered in conjunction with the following drawings, in which:

Table I lists properties and desired requirements for plastic parts for a preferred embodiment of the instant invention.

FIG. 7 is a view of a combination of parts of the embodiment of FIG. 1.

FIG. 8 is a further view of parts of the embodiment of FIG. 1.

FIG. 9 illustrates portions of a part of the embodiment of FIG. 1.

FIG. 11 illustrates part of the embodiment of FIG. 1 and of FIG. 10.

FIG. 12 illustrates a combination of parts of the embodiment of FIG. 1.

Table II coordinates part numbers of FIGS. 17 A–E with alphabetic part indicators of FIGS. 1–16.

The drawings are primarily illustrative. It would be understood that structure may have been simplified and details omitted in order to convey certain aspects of the invention. Scale may be sacrificed to clarity.

DESCRIPTION OF THE PREFERRED EMBODIMENTS

Figure 1:
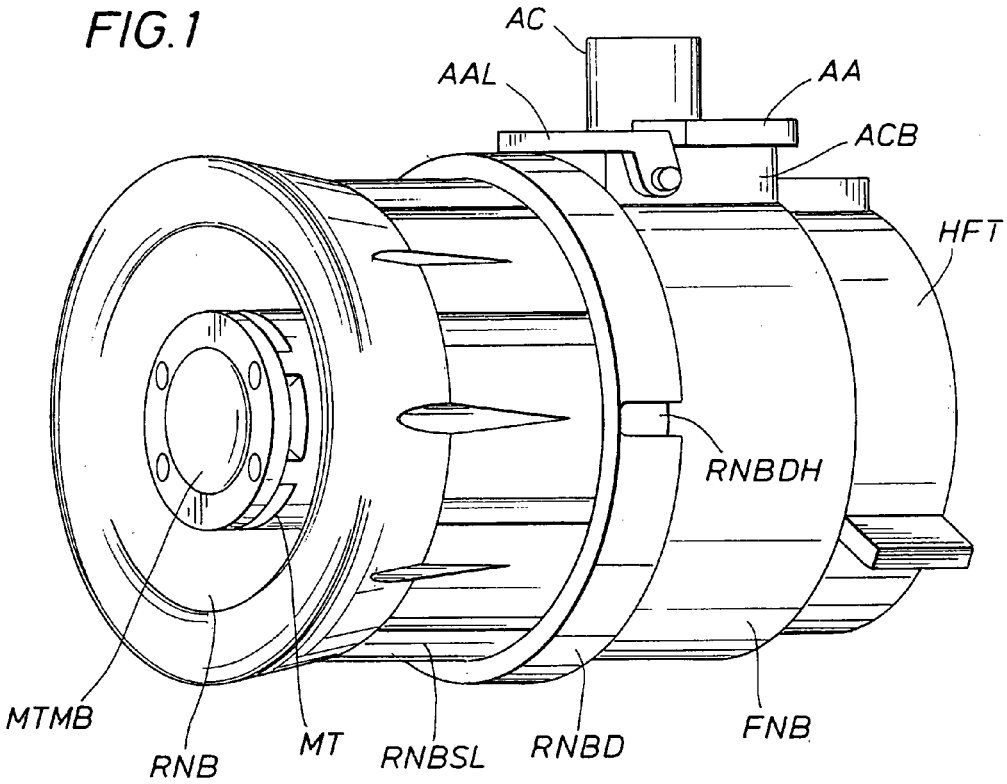
FIG. 1 is a prospective view of a preferred embodiment.

FIG. 1 illustrates a fire fighting nozzle of a preferred embodiment of the instant invention. The nozzle includes what is referred to as a fixed nozzle body or barrel portion labeled FNB and a rotating nozzle body or barrel portion labeled RNB.

The FNB and RNB body portions, as disclosed more fully below, are barrel elements that rotate relative to each other. The relative rotation between the two nozzle or barrel elements causes metering tube element MT, better illustrated in FIG. 11, containing a bafflehead with an attached mixing chamber plate and a sleeve with various additive ports, to rotate. Rotating nozzle body elements are coordinated with the metering tube elements such that metering tube elements rotate with rotating body elements. A pattern contral sleeve RNBSL, as is known in the art, is also indicated.

Figure 14:
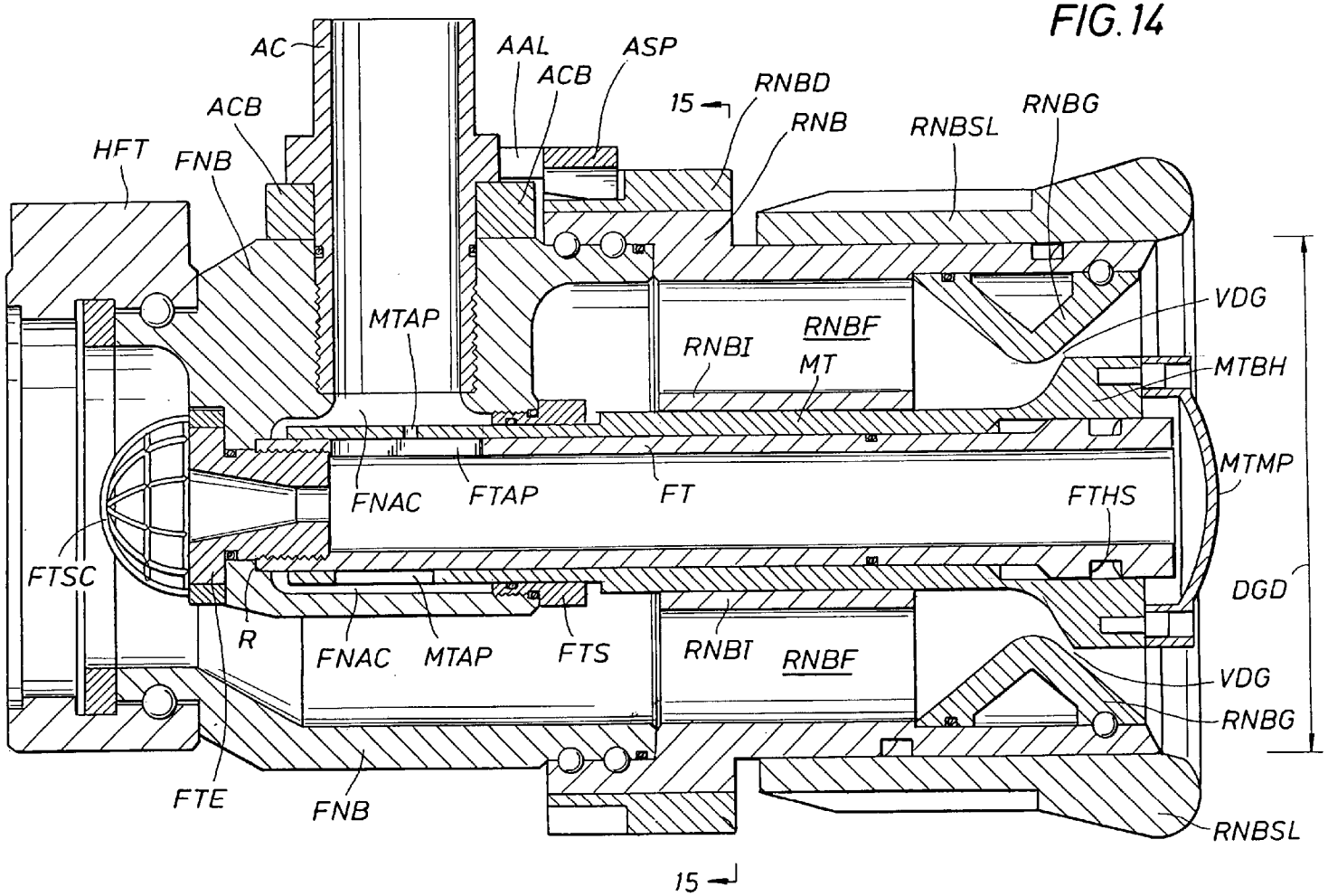
FIG. 14 is a Y Z cross section drawing, where Z corresponds with the longitudinal axis of the nozzle.
Figure 15:
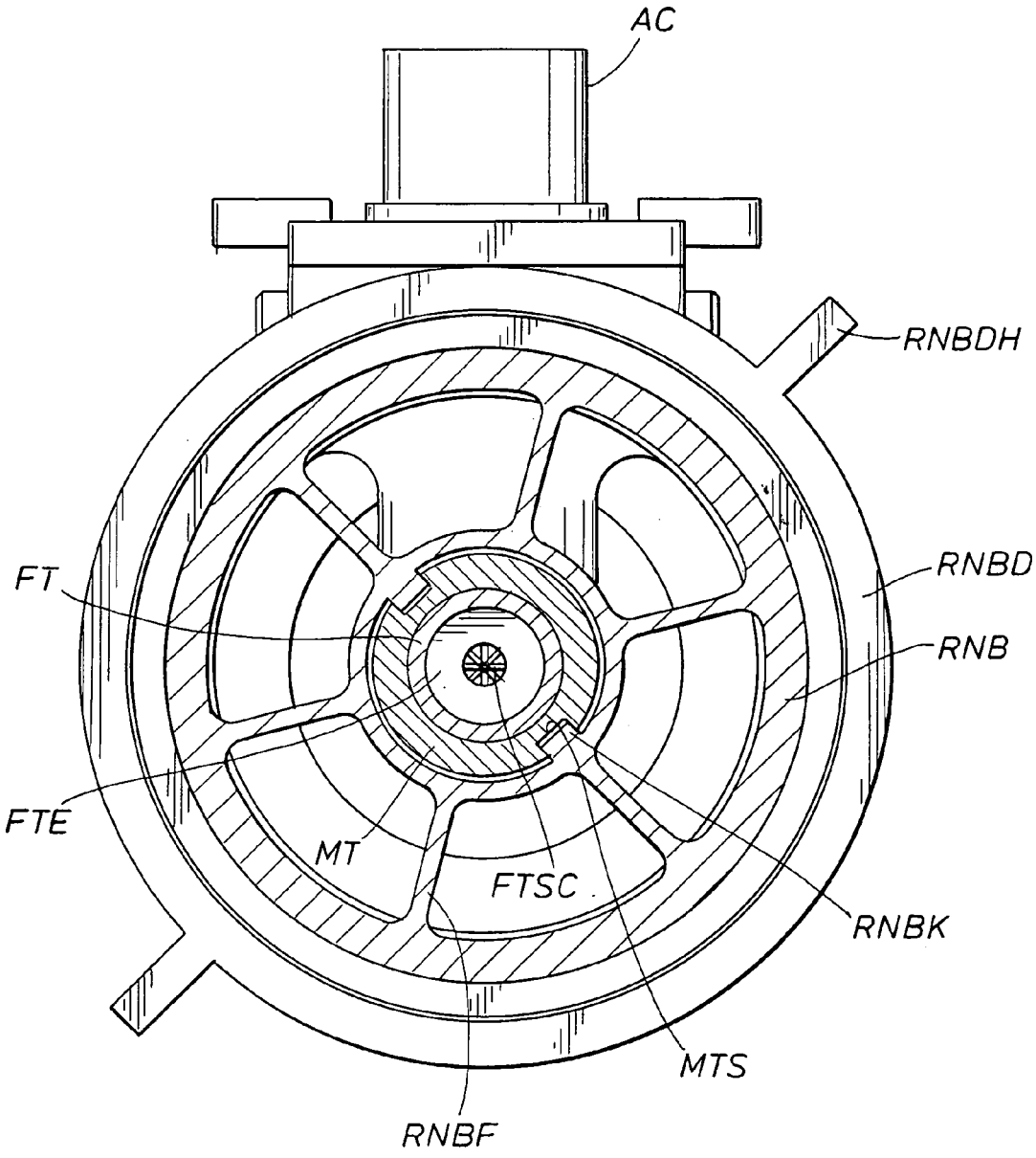
FIG. 15 is a X Y cross section drawing of the nozzle illustrated in FIG. 14. Both drawings have been colored to show flow of the fire fighting fluid (blue) and additive (orange.)
Figure 16A:
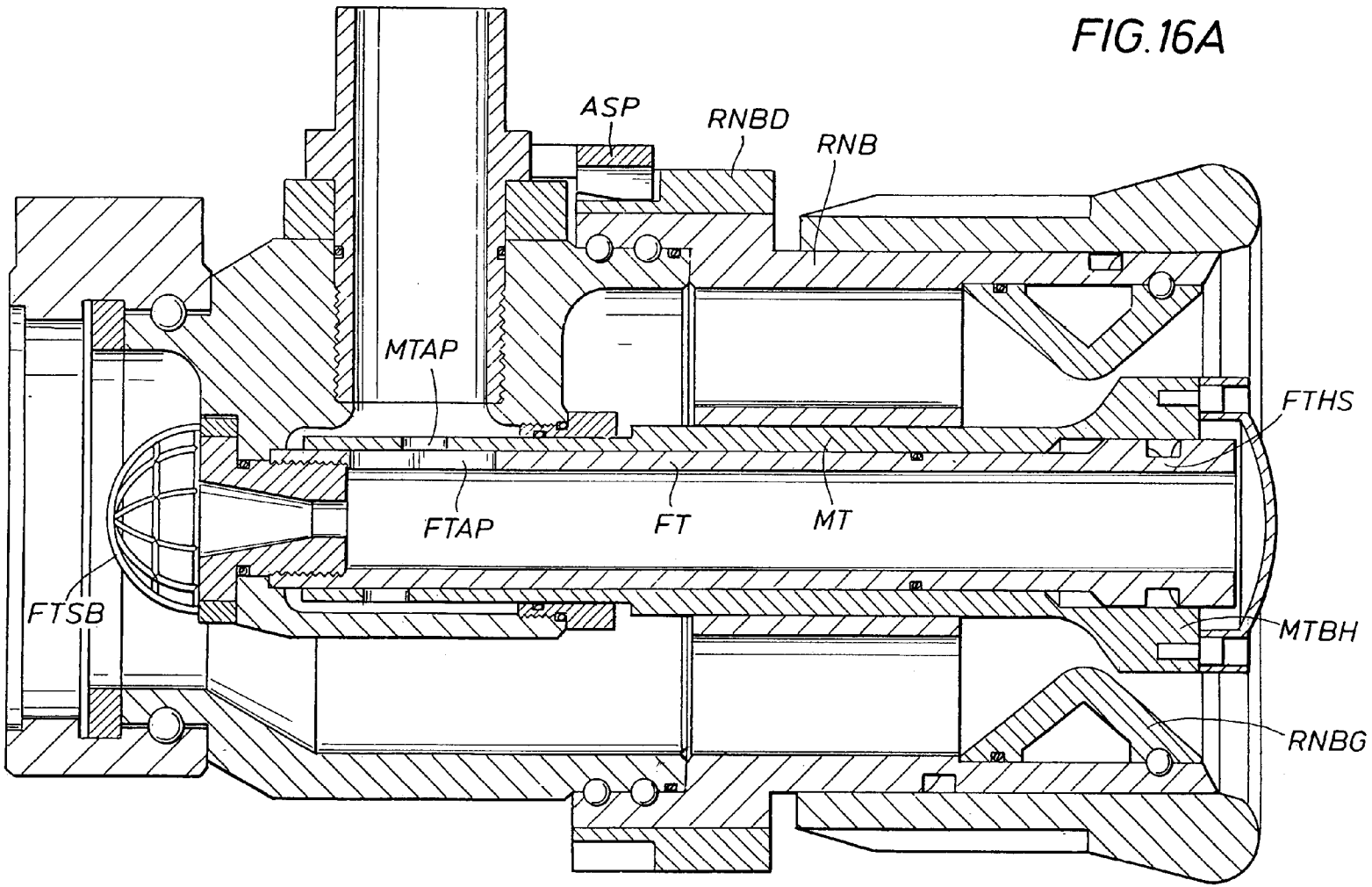
FIGS. 16 A–E illustrate the nozzle of the embodiment of FIGS. 14 and 15, set for different flow rates and additive ratios.
Figure 16B:
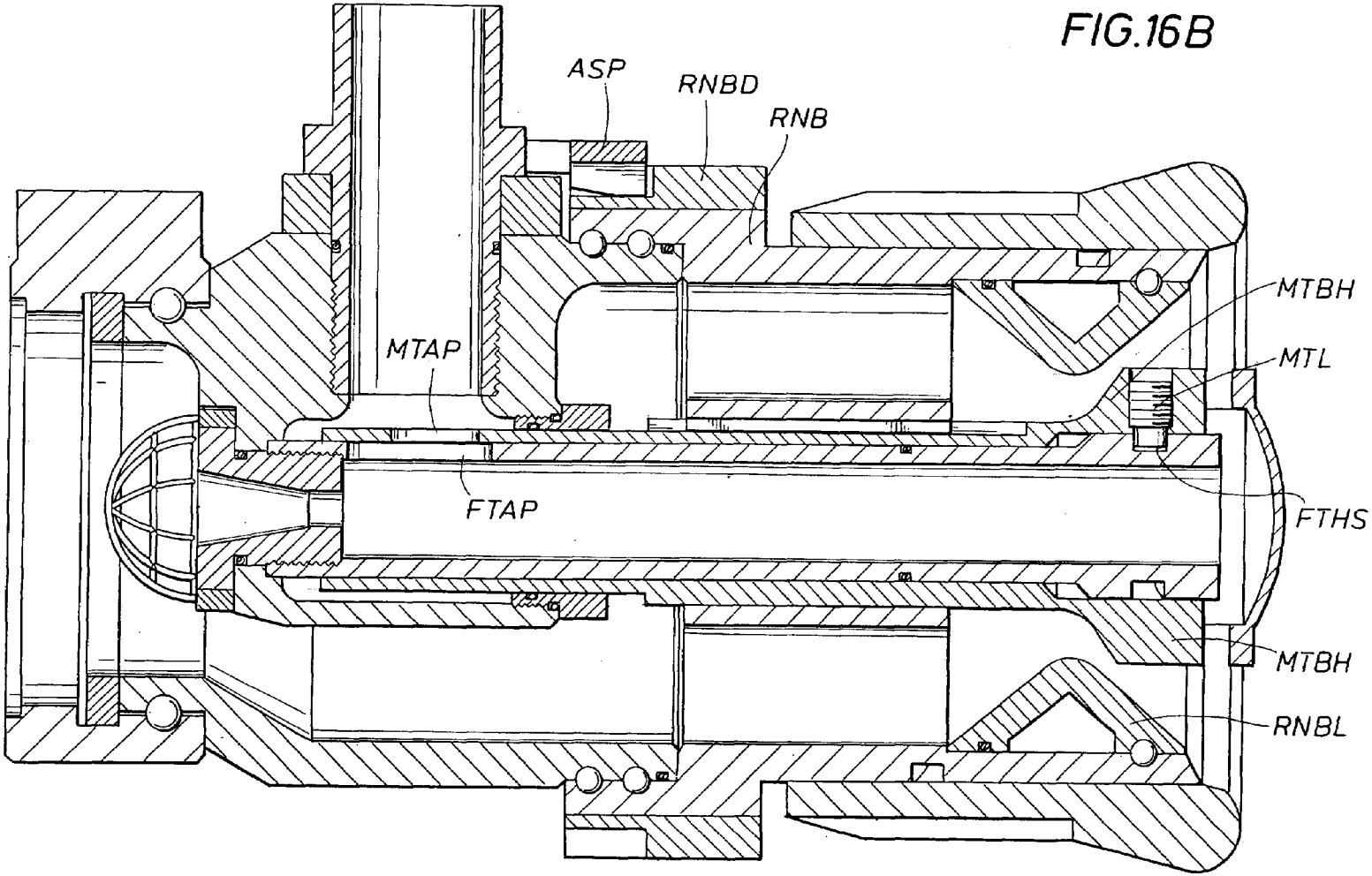
Figure 16C:
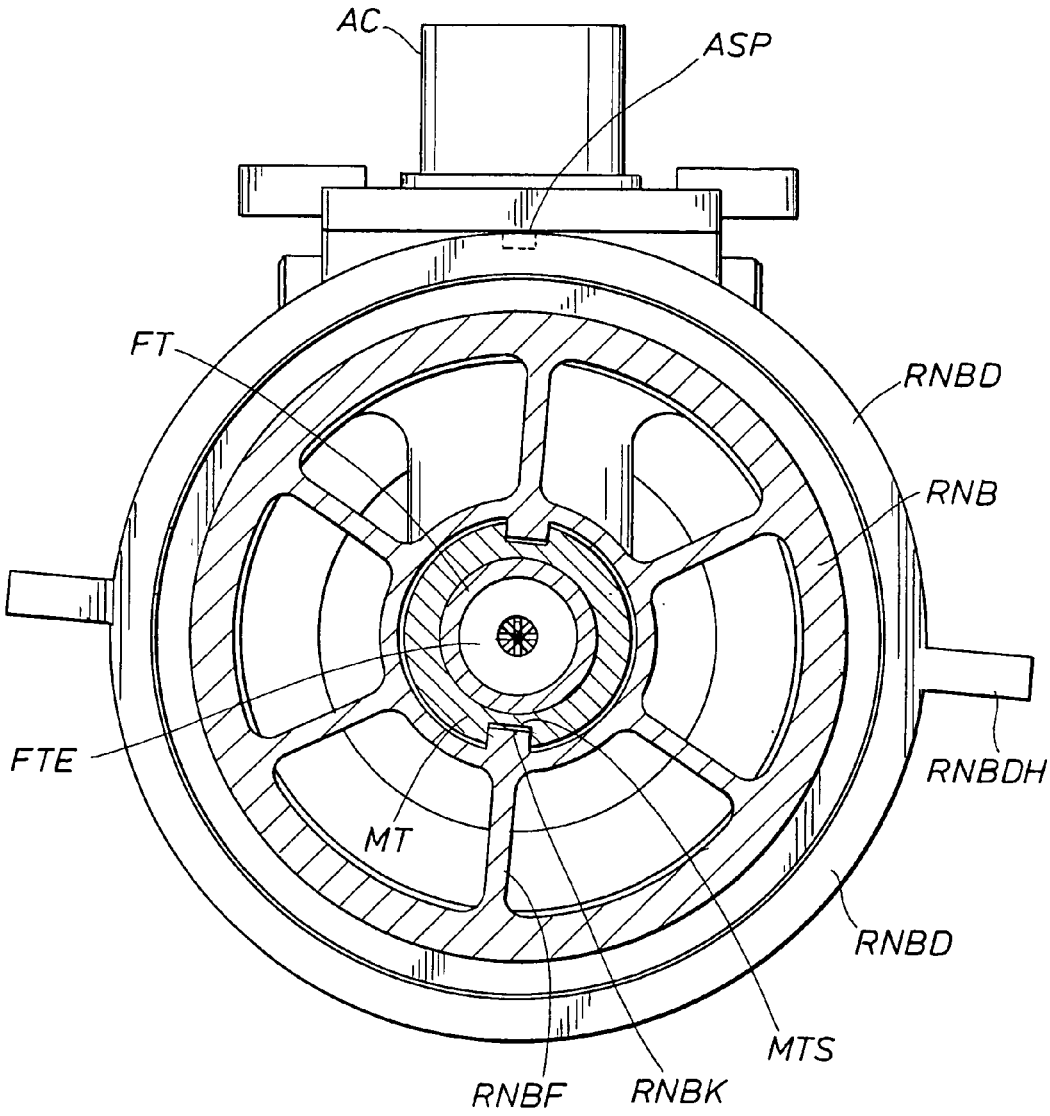
Figure 16D:
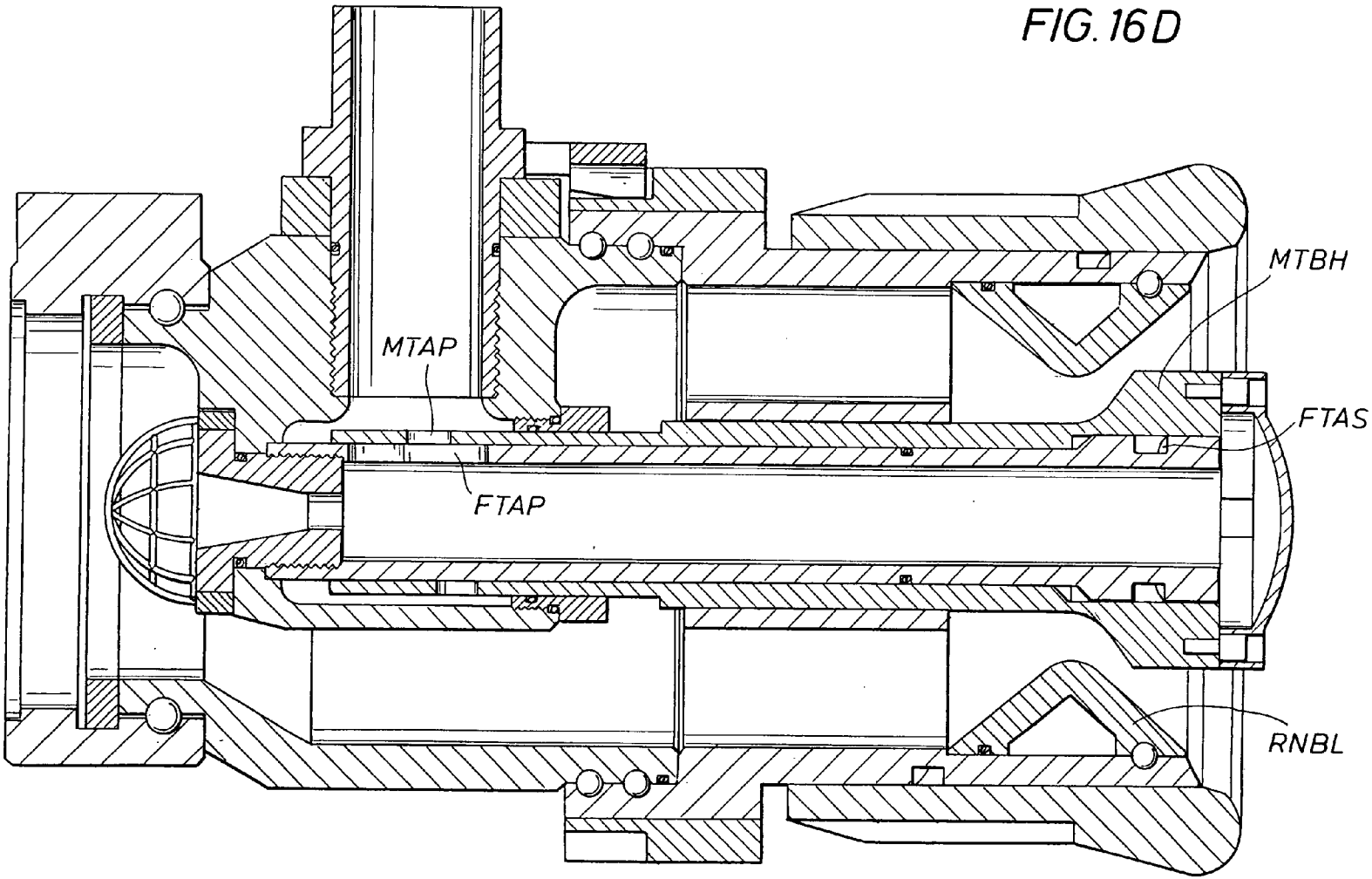
Figure 16E:
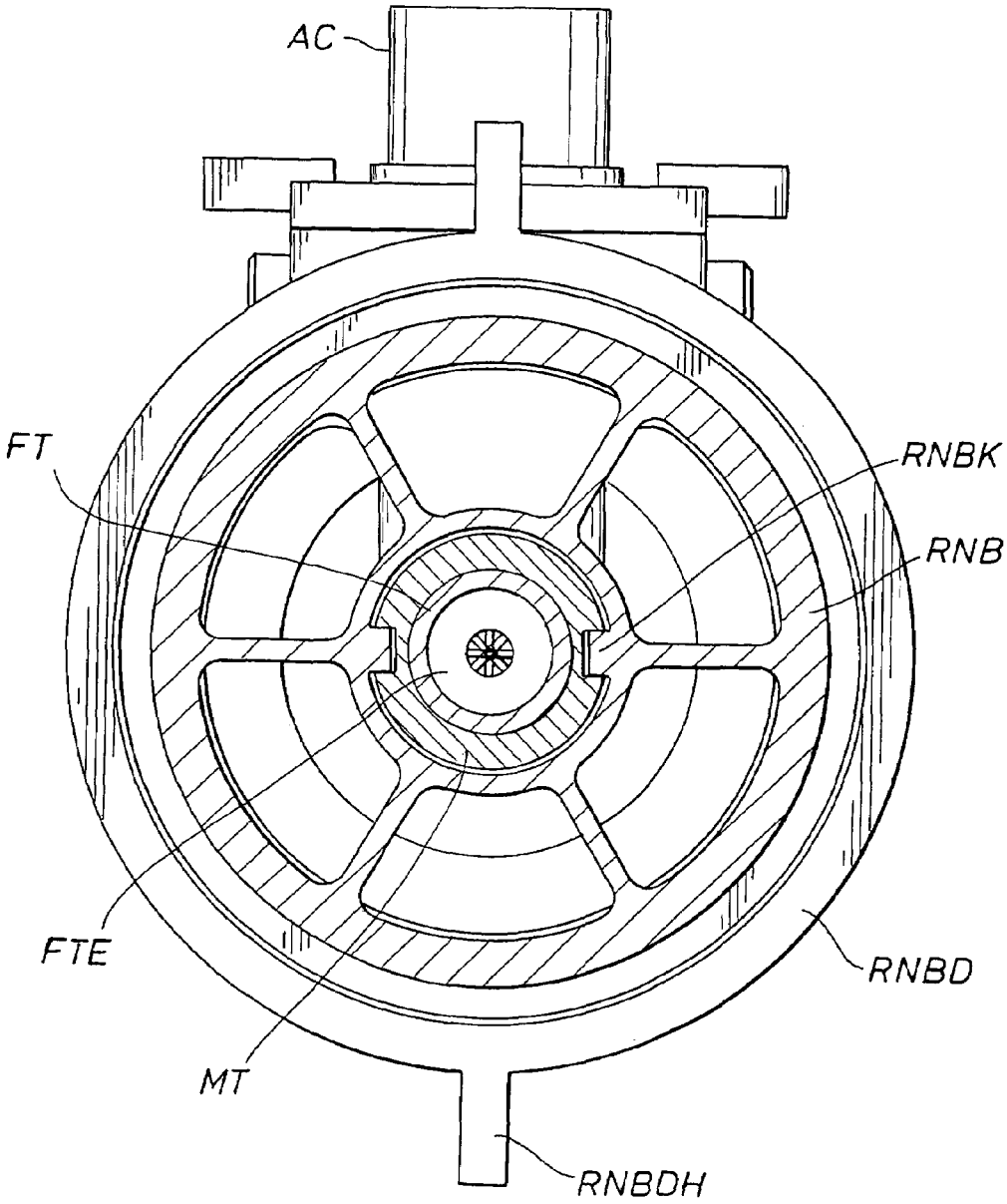
Figure 17A:
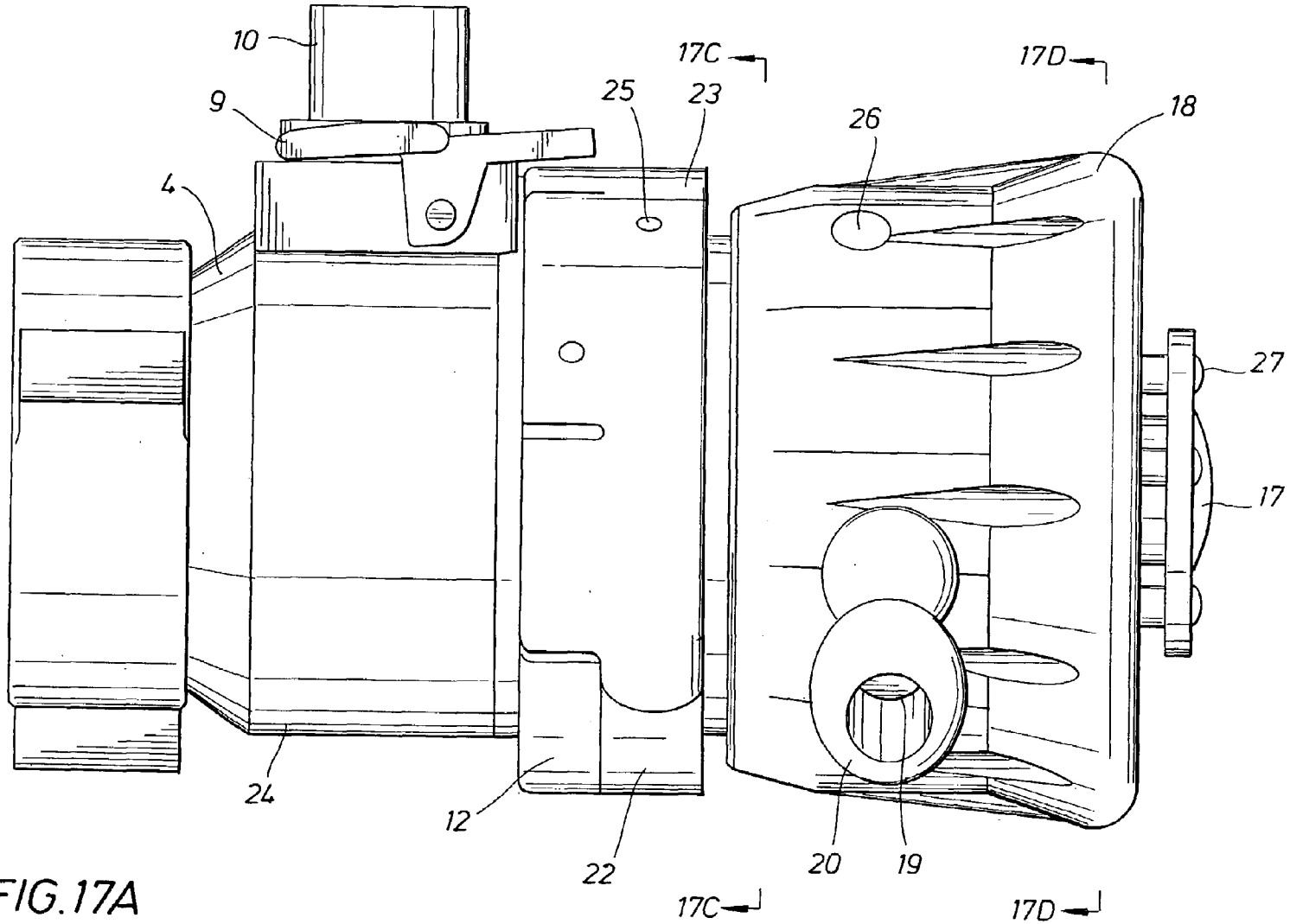
FIGS. 17 A–E are a cross section of the embodiment of FIG. 1.
Figure 17B:
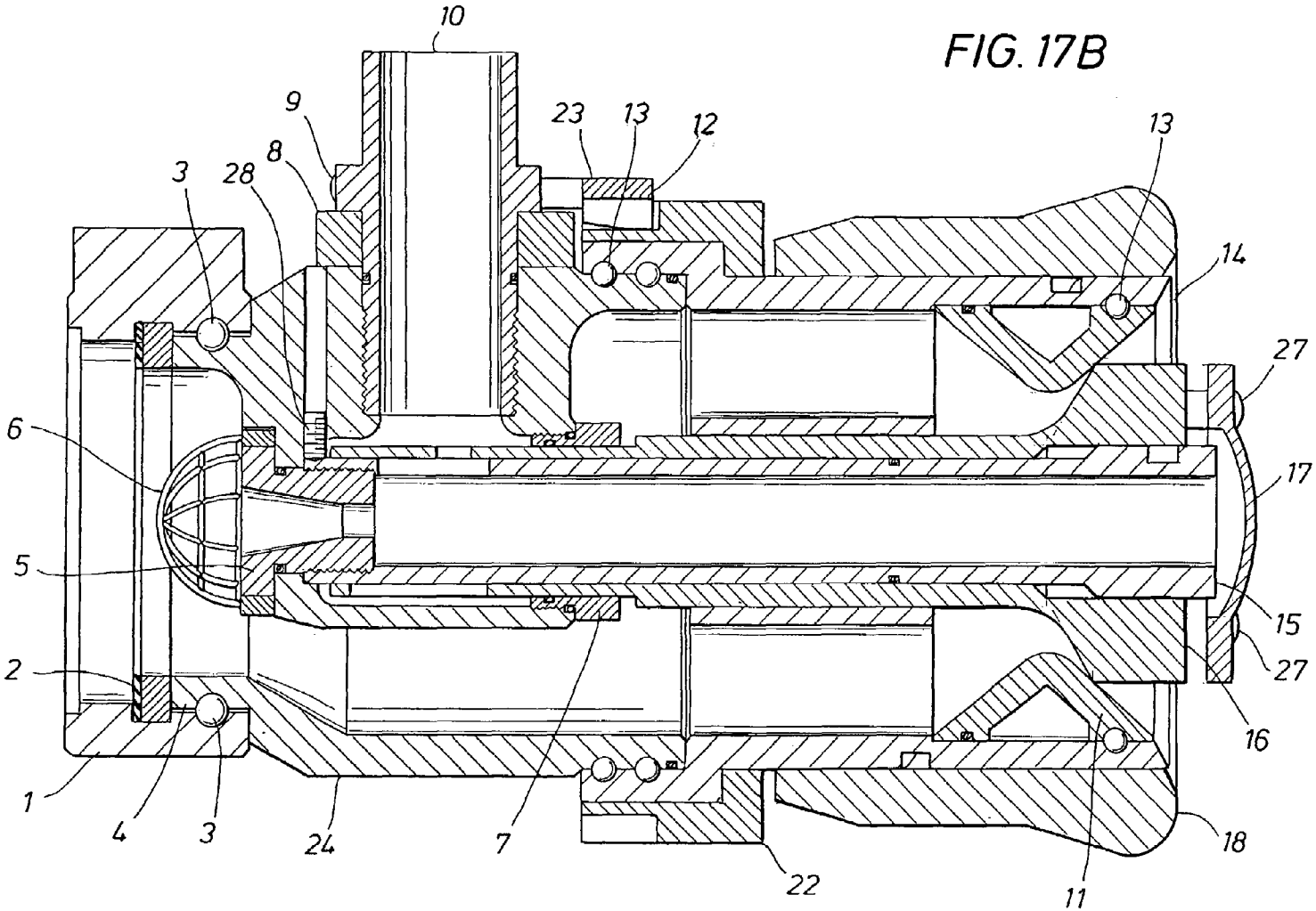
Figure 17D:
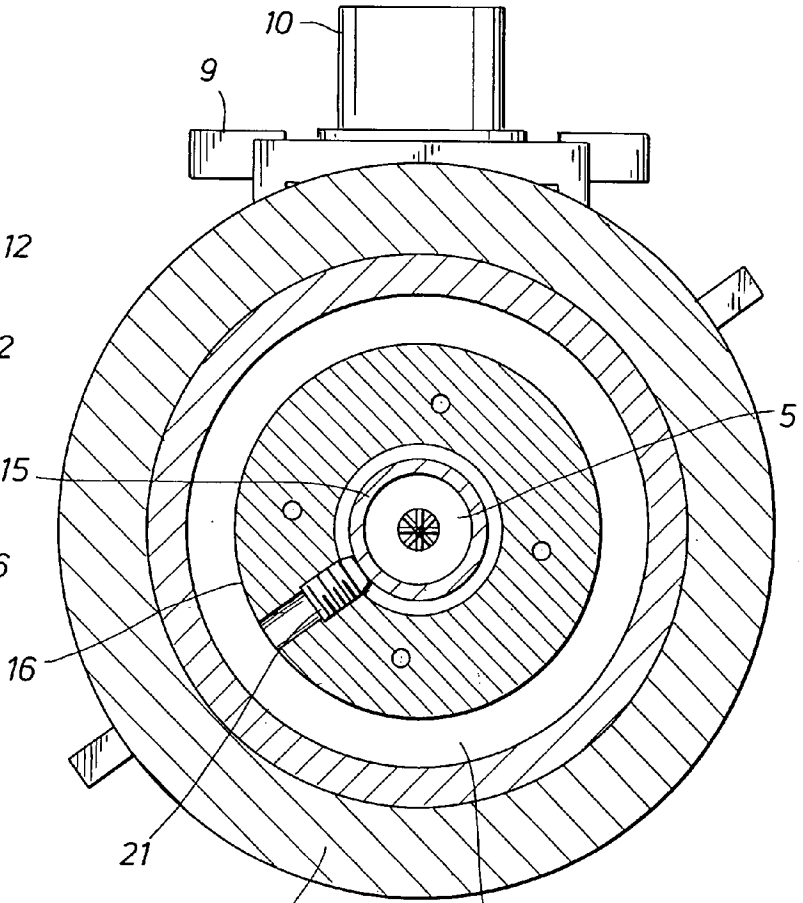
Figure 17C:
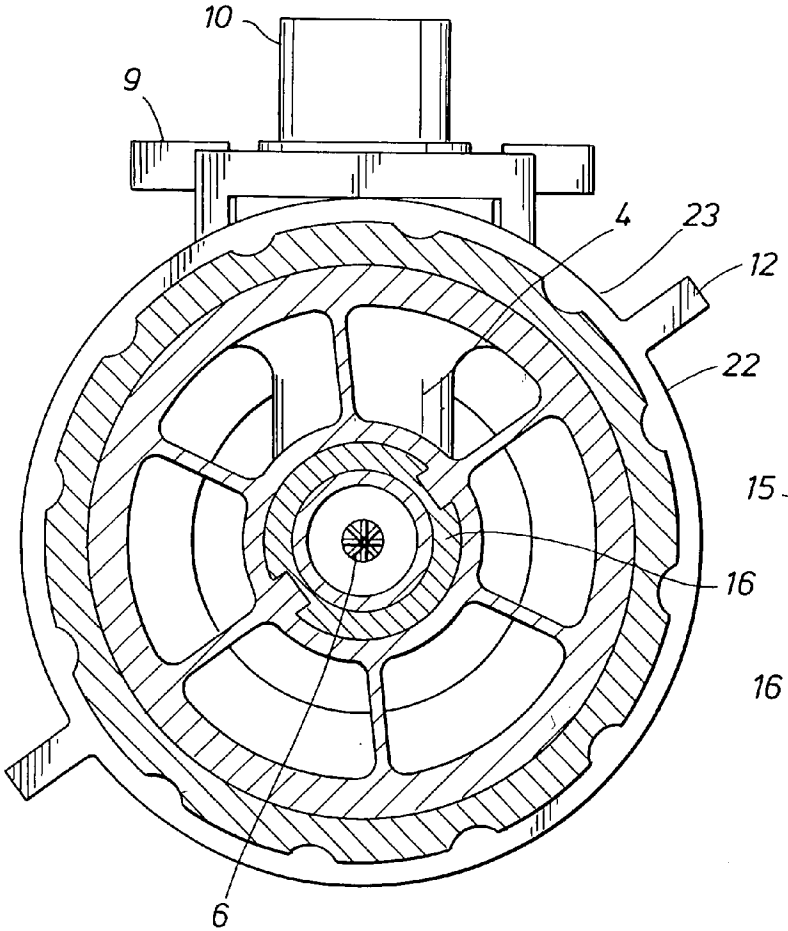

The nozzle of FIG. 1 contains a passageway for the supply of an additive into the major fluid flow barrel of the nozzle. Additive flows into the nozzle through a fluid communication channel defined by element AC. FIGS. 14 and 15 illustrate in color the flow of fire fighting fluid (blue) and additive (orange) through the nozzle.

Figure 2:
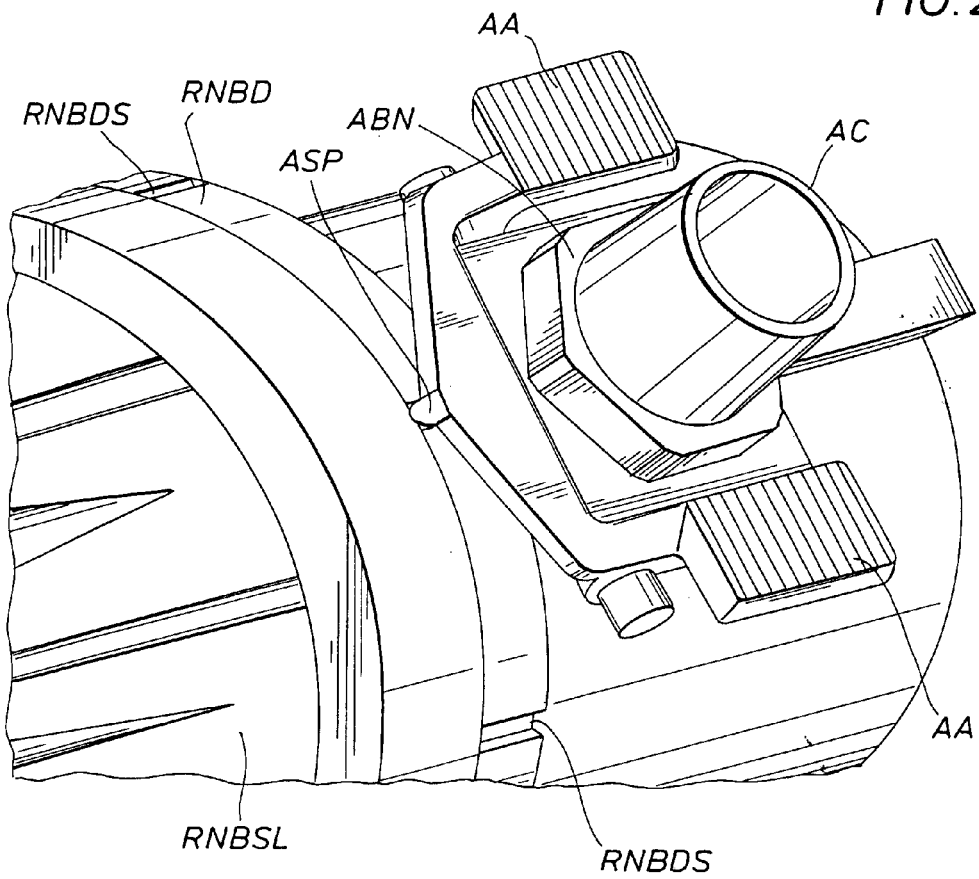
FIG. 2 is a more detailed view of a portion of the embodiment of FIG. 1.

As more particularly illustrated in FIG. 2, element AC is associated with element ABN that helps to affix element AC to the nozzle. Around element AC is affixed a pivoting arm AAL having a tilting point ASP. Pivoting arm AAL tilts on its axis, effected by pressing down on pads AA, to raise and lower the tilting element point ASP. Rotating nozzle element RNB contains slots RNBDS. Element point ASP can be raised, by pressure on pads AA, such that the point ASP rises out of one rotating nozzle element RNDBS slot. The nozzle ring or dial element RNDB can then be rotated such that element ASP can be lowered into a succeeding or other RNDBS slot. Each slot RNDBS provides for the coordination and selection of particular flow rate (selected discharge gap) and a particular additive ratio.

Figure 3:
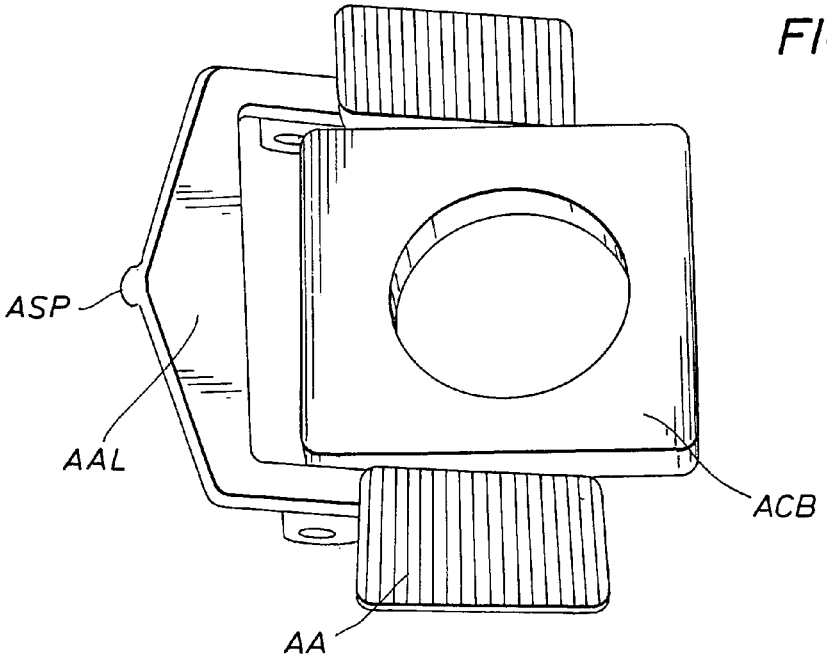
FIG. 3 is a view of a part of the embodiment of FIG. 1 and FIG. 2.
Figure 4:
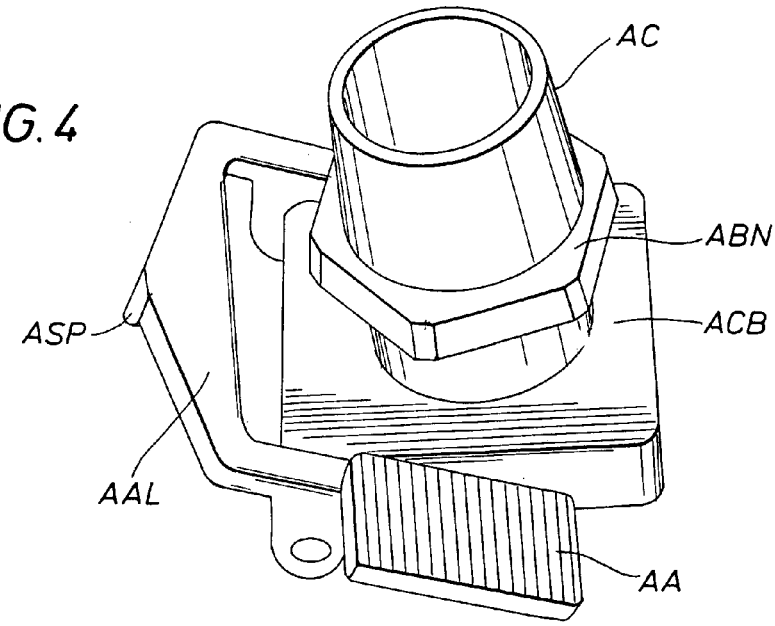
FIG. 4 is a view of a combination of parts of the embodiment of FIGS. 1 and 2.

FIG. 3 further illustrates the tilting arm AAL with its point ASP and a base element ACB and the pressure pads AA. FIG. 4 further illustrates the above elements including affixing element ABN.

Figure 5:
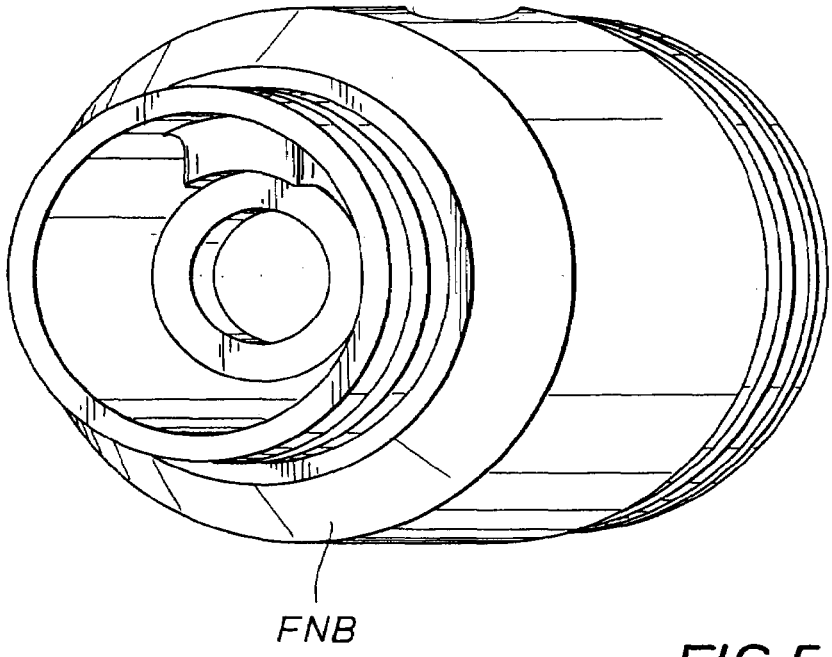
FIG. 5 is a view of a part of the embodiment of FIG. 1.

FIG. 5 illustrates a nozzle or barrel element FNB. Nozzle or barrel element RNB rotates with respect to nozzle or barrel element FNB. Nozzle element FNB defines a passageway or chamber for additive fluid, as also illustrated in FIG. 14. Although barrel elements FNB and RNB rotate with respect to each other, element FNB is typically viewed as fixed since it would be awkward to rotate element AC to any substantial degree.

Figure 6:
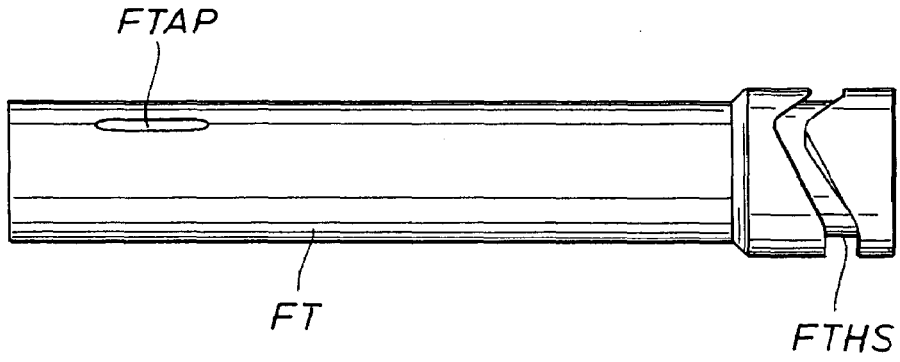
FIG. 6 is a view of a part of the embodiment of FIG. 1.
Figure 10A:
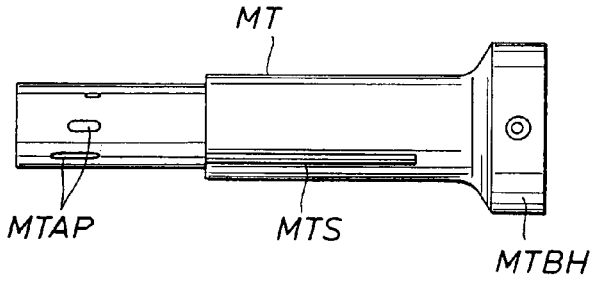
FIG. 10 illustrates a plurality of parts, separated, of the embodiment of FIG. 1.
Figure 10B:
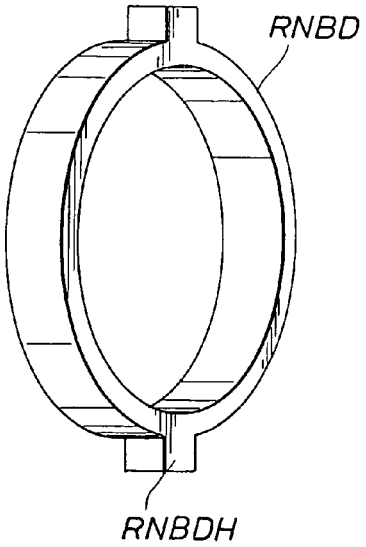
Figure 10C:
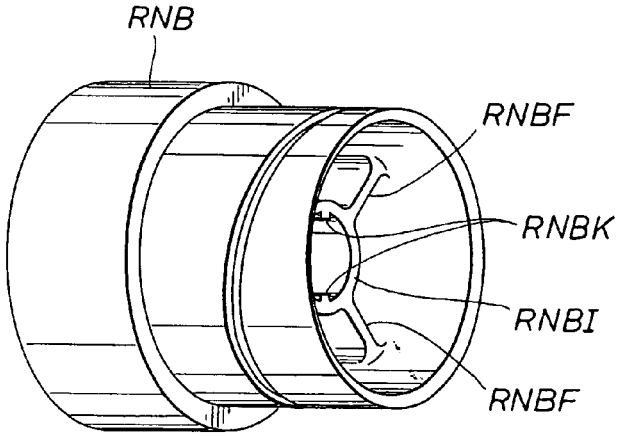
Figure 10D:
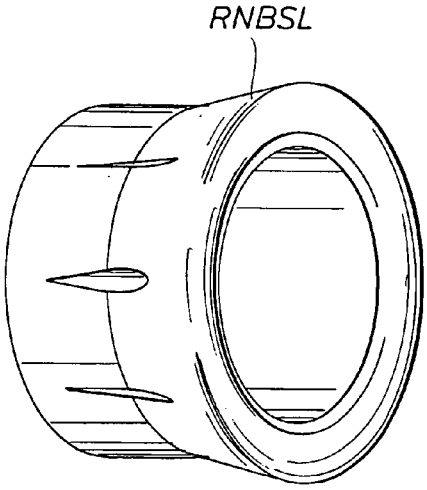

FIG. 6 illustrates a fixed tube nozzle element FT. Nozzle element FT is designed to be secured to nozzle element FNB, as further illustrated in FIG. 7. Additive that enters the nozzle through the passageway defined by element AC will enter an additive passageway FNAC defined by element FNB and will subsequently pass through a metering port MTAP and a fixed tube port FTAP and into the interior of fixed tubular element FT. It can be seen that interior fixed tube element FT contains a helical or spiral slot FTHS at its downstream end. The term "helical or spiral" is used to indicate general shape. Neither a precise helix or spiral is necessary.

FIG. 8 illustrates an eductor fitting FTE and a screen FTSC that are attached to the upstream end of element FT. FIG. 9 illustrates in greater detail the helical or spiral slot FTHS at the downstream end of element FT. Element FT in FIG. 9 is also shown as having metering tube lug or pin MTL in its helical or spiral slot.

FIG. 10 illustrates parts that combine generally to form parts of rotating nozzle body RNB, as well as metering tube MT, which fits inside of and rotates with nozzle body RNB. FIG. 10 illustrates annular ring dial RNBD having handle RNBDH. Annular ring RNBD attaches to nozzle element RNB, such as by set screw. Nozzle or barrel element RNBL contains interior fins RNBF attaching to an inner annular cylinder labeled RNBI. Inner annular cylinder RNBI contains two keyways RNBK. Sliding sleeve RNBSL, as discussed above, is also shown in the drawing. Also, in FIG. 10 is illustrated slots MTS. Part MT rotates with RNB by virtue of two slots MTS into which the keyways RNBK fit. Part MT also contains a location MTLL, illustrated in FIG. 11, for locating a lug or pin MTL to turn within the helical or spiral slot FTHS of element FT. The movement of the pin or lug in the slot tends to translate tube MT with respect to body portion RNB and FNB as tube MT rotates.

FIG. 11 illustrates part MT and its portions in greater detail. As can be shown in FIG. 11, MT provides at its downstream end a bafflehead MTBH that combines with other elements of the nozzle to define a variable discharge gap VDG. See FIG. 14. At the upstream end of element MT a sleeve contains a series of variably sized orifices MTAP. Orifices MTAP rotate with respect to fixed orifice FTAP in additive passageway FNAC defined by element FNB. Depending upon the alignment of a variable orifice MTAP with fixed orifice FTAP in the additive chamber, the fluid communication passageway for the additive from its source through nozzle N is figured and adjusted.

FIG. 12 illustrates the coordination of element MT with its bafflehead MTBH at the downstream end, together with nozzle element RNBG, which should be affixed to the inside passageway of the nozzle or barrel element RNB at the discharge end. Element RNBG and the downstream bafflehead end of element MT define a variable discharge gap VDG therebetween for the nozzle, thereby permitting and defining a variation of flow in the nozzle. That is, as element MT translates along the longitudal axis of the nozzle with respect to element RNBG, the discharge gap VDG is widened and/or narrowed. Further, as element MT rotates, different orifices MTAP are aligned under a fixed orifice FTAP in relation to additive passageway FNAC. Again, element MT rotates with RNB by virtue of a keyway and slot mechanism between them. Element MT translates with respect to nozzle elements by virtue of movement of a lug or pin of element MT in a helical or spiral slot of element FT.

Figure 13:
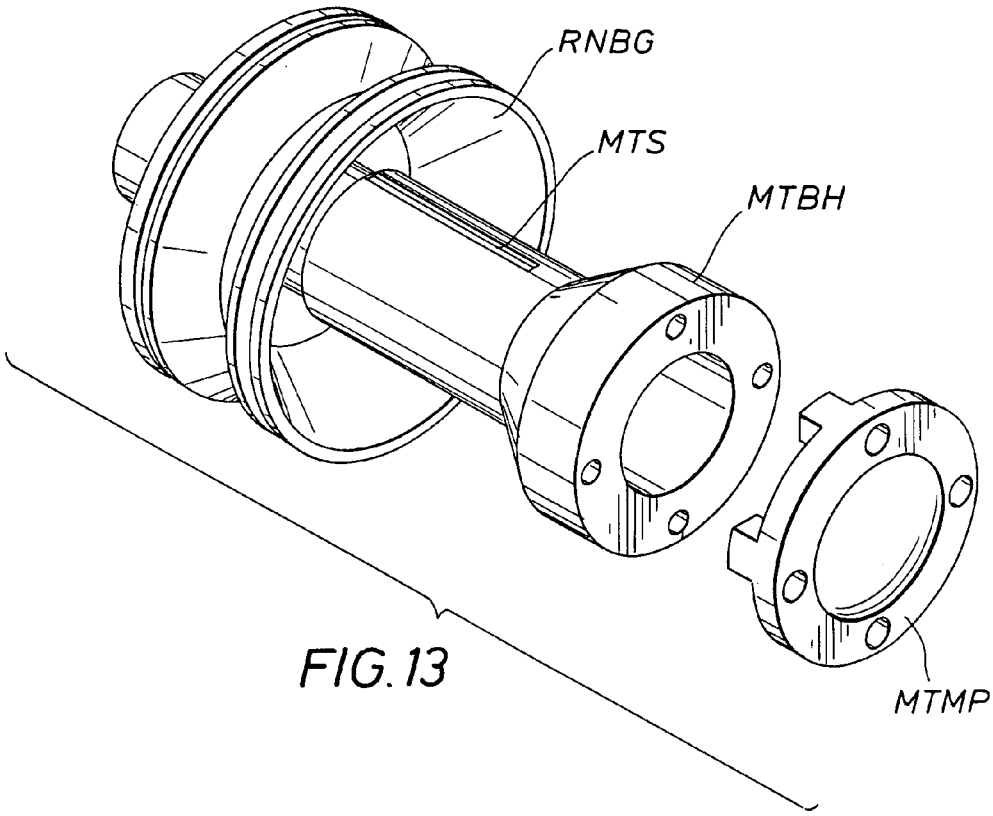
FIG. 13 illustrates a combination of parts of the embodiment of FIG. 1.

FIG. 13 illustrates a mixing chamber plate MTMP, typically affixed to the downstream end of element MT providing the bafflehead.

FIGS. 14 and 15 provide two cross section views of the nozzle of the embodiment of FIG. 1. By virtue of FIGS. 14 and 15 the assembly of the above referenced parts into the nozzle is illustrated, and the flow of fire fighting fluid (blue) and additive (orange) is indicated. In FIG. 14 fitting HFT is a fitting provided for attachment between a hose or line and nozzle element FNB. Element FTS attaches to fixed element FNB. Element FTS provides a seal to separate a high pressure zone from a low pressure zone within the nozzle. Element FTS helps permit element MT of the nozzle to translate and rotate within it. FIG. 14 illustrates additive chamber FNAC defined in element FNB with tubular element FT shown as providing an additive port FTAP. Port FTAP, and whichever additive port MTAP of element MT that is rotated within and aligned with fixed additive port FTAP, if any, together define an additive passageway flowing through element FNB and downstream through element FT.

An X Y cross section of the embodiment of FIG. 1 and FIG. 14 is provided in FIG. 15 and indicated by location in FIG. 14.

FIGS. 16 A–E are similar to FIGS. 14 and 15, with the difference that they show orientations of the nozzle for different flow rates and different additive proportioning percentages. FIGS. 14 and 15 show a nozzle where a flow rate of 250 gpm and a proportioning ratio of 1% has been selected. FIG. 16A shows an orientation of the nozzle arranged for a flow rate of 250 gpm and a ratio of 3%. FIG. 16B illustrates an orientation of the nozzle for a flow rate of 500 gpm and an additive proportioning ratio of 3%. FIG. 16C is a Y Z cross section of the nozzle in accordance of FIG. 1 showing an arrangement of the nozzle for a flow rate of 500 gpm and an additive ratio of 3%. FIG. 16D illustrates an orientation of the nozzle for a flow rate of 750 gpm and an additive ratio of 1%. FIG. 16E illustrates a flush position wherein no additive will flow into the nozzle.

FIGS. 17 A–E illustrate the nozzle of the preferred embodiment of FIG. 1, in perspective and in cross section.

In FIGS. 17 A–E parts are numbered. Table II correlates these numbered parts with the alphabetically labeled parts of FIGS. 1–16. In FIGS. 17 A–E part number four corresponds to fixed nozzle body FNB; part number 5 corresponds to fixed tube eductor FTE; part number 6 corresponds to fixed tube screen FTSC; part number 8 corresponds to additive chamber block ACB; part number 10 corresponds to foam or additive inlet channel AC; part number 15 corresponds to a fixed tube FT; part number 16 corresponds to metering tube MT; part number 17 corresponds to the metering tube mixing plate MTMP and part number 18 corresponds to the pattern control sleeve RNBSL. The other numbered parts on Table II have not previously been referred to.

Figure 18:
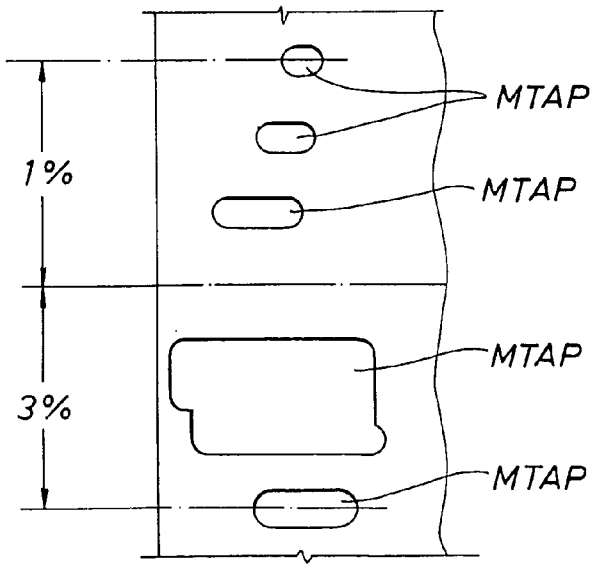
FIGS. 18 illustrates coordinated additive ports for a preferred embodiment.

FIG. 18 illustrates the metering tube additive ports MTAP in their dimensions as if the cylindrical metering tube were straightened into a flat strip. FIG. 18 gives a sense of the calibration of the metering tube additive ports with the position of the metering tube both by rotation and longitudinally within the nozzle.

The instant inventor experimented with the use of plastic for component parts for fire fighting nozzles having diameters of 2½ inches or higher and flowing from 150 gpm to 750 gpm. Surprisingly, tests showed that plastic nozzle components can withstand the high water pressures as well as the necessary high operating temperatures, the high reaction loads and the high thread stresses. Good performance was achieved with a plastic that can withstand temperatures up to at least 400° F. This is true even though in the process the instant inventor determined that the maximum practical temperature for operating a fire fighting nozzle is 250° F. For operations at temperatures above 250° F., the o-rings and the hoses associated with the additive and its supply system begin to fail, even if all of the other parts are made of metal.

Primary advantages of a plastic construction are as follows:

- lighter weight (approximately 40% less than aluminum or ⅕ that of brass;)
- non-corrosive;
- customers in fire fighting industry make plastic in one form or another, rather than brass or aluminum, and
- economical.

Furthermore, plastics, within limits, permit selecting features that are important to design, such as yield strength, coefficient of friction and creep temperature. Key features selected for a preferred embodiment of a fire fighting nozzle are illustrated by Table I.

The material of construction employed in one preferred embodiment nozzle design is a composite. The nozzle was preferably comprised essentially of parts constructed of aluminum, of an aluminum/magnesium alloy and/or of a fiber reinforced high temperature polymer. A high temperature polymer should be able to withstand temperatures of up to at least 300° F. A preferred fiber reinforced high temperature polymer is manufactured by RTP Company and is known as RTP 205 HS UV. Such a composite of materials offers advantages of light weight.

There are many advantages to a lighter weight construction. Lighter weight is less of a burden for a firefighter who has to carry fire fighting equipment around and may have to climb over pipe racks and other obstacles. Secondly, a lighter weight nozzle is more friendly on the end of the monitor than a heavier weight nozzle would be. If the monitor is tiller-bar operated it means less effort for the operator. On electrically or hydraulically actuated monitors, there is a limit to the weight they are designed to handle. There have been times when metal nozzles were simply too heavy for these monitors to handle.

An aluminum/magnesium alloy construction combination used to manufacture many parts of a preferred embodiment of the instant invention has a high strength to weight ratio and has an improved resistance to corrosion, as compared to conventional aluminum alloys.

To further enhance corrosion resistance, the metals are preferably hard coat anodized to military specifications A preferred polymer is fiber reinforced, heat stabilized, UV protected and essentially impervious to corrosion. Such material has a high impact strength and excellent yield strength, not to mention the fact that the material is 42% lighter than aluminum.

In preferred embodiments of the invention metering tube MT, including bafflehead MTBH and metering ports MTAP, as well as barrel element RNB, with its interior cylinder, fins and keyways, are both constructed of a fiber reinforced high temperature polymer. In particular, they are comprised of material RTP 205 HS UV 2 Black polymer. The same black polymer is also preferably used for gap defining element RNBG, mixing plate MTMP and sliding sleeve RNBSL.

The foregoing description of preferred embodiments of the invention is presented for purposes of illustration and description, and is not intended to be exhaustive or to limit the invention to the precise form or embodiment disclosed. The description was selected to best explain the principles of the invention and their practical application to enable others skilled in the art to best utilize the invention in various embodiments. Various modifications as are best suited to the particular use are contemplated. It is intended that the scope of the invention is not to be limited by the specification, but to be defined by the claims set forth below. Since the foregoing disclosure and description of the invention are illustrative and explanatory thereof various changes in the size, shape, and materials, as well as in the details of the illustrated device may be made without departing from the spirit of the invention. The invention is claimed using terminology that depends upon a historic presumption that recitation of a single element covers one or more, and recitation of two elements covers two or more, and the like. Also, the drawings and illustration herein have not necessarily been produced to scale.

What is claimed is:

1. A fire fighting nozzle having a selectively adjustable discharge gap and an independently selectable, gap coordinated additive proportioning system, the nozzle comprising:

nozzle elements defining a selectively adjustable discharge gap, the elements structured in combination such that the gap is selectively adjustable between a plurality of positions;

an additive passageway associated with the nozzle, the passageway defined in a path of fluid communication between a nozzle discharge and an additive source, the passageway selectively adjustable between at least four configurations, the configurations correlating at least two discharge gap positions with at least two additive proportioning ratios; and wherein a selective adjustment of nozzle elements is independent of, but coordinated with, a selective adjustment of the additive passageway.

2. The nozzle of claim 1 wherein the selectively adjustable discharge gap is defined by relatively adjustable barrel and baffle elements.

3. The nozzle of claim 2 wherein a baffle element rotates and translates with respect to a barrel axis.

4. The nozzle of claim 3 wherein the rotating and translating baffle element includes a sleeve portion having a plurality of differently sized ports, the baffle element and the sleeve portion structured in combination such that as the baffle element rotates and translates with respect to a barrel axis, the sleeve rotates to interpose a differently sized port in an additive passageway.

5. The nozzle of claim 2 wherein a relative rotation of portions of the nozzle causes an adjustment of relative position between a barrel element and a baffle element.

6. The nozzle of claim 5 that includes a helical or spiral channel and a following lug or pin, each associated with one of a relatively rotating portion of the nozzle, such that the relative rotating causes the baffle element to translate.

7. The nozzle of claim 5 that includes a keyway and slot, each associated with one of the baffle element portion or a relatively rotating nozzle portion, such that rotation of a nozzle portion causes rotation of the keyway and slot and baffle element.

8. The nozzle of claim 1 wherein a relative rotation of portions of the nozzle causes an adjustment of an additive passageway.

9. The nozzle of claim 1 wherein the discharge gap has a diameter of at least 2½ inches and the nozzle has a flow rate of at least up to 250 gpm.

10. A method for discharging fire fighting fluid at a selectively adjustable flow rate and providing for independently selectable, gap coordinated additive proportioning, comprising relatively adjusting nozzle elements to define one of a plurality of selectively adjustable discharge gaps, each gap coordinated with one of a plurality of selectable additive proportioning ratios;

adjusting an additive passageway, defined in a line of fluid communication between a nozzle discharge and an additive source, to one of at least four configurations, the configurations correlating at least two discharge gap positions with at least two additive proportioning ratios; and wherein the relative adjusting of nozzle elements is coordinated with an adjustment of additive passageway and wherein discharge gap and additive proportioning ratios can be independently selected.

11. The method of claim 10 wherein relatively adjusting nozzle elements includes relatively adjusting a barrel element and a baffle element.

12. The method of claim 11 that includes helixing or spiraling a baffle element around a barrel axis.

13. The method of claim 11 that includes rotating a sleeve portion of the baffle element to interpose one of a plurality of orifices in an additive passageway independently selected.

14. The method of claim 10 wherein a discharge gap has a diameter of at least 2½ inches and that includes discharging fire fighting fluid at least up to 250 gpm.

* * * * *